US005617714A

United States Patent [19]

Fehrer

[11] Patent Number: 5,617,714

[45] Date of Patent: Apr. 8, 1997

[54] DRAFTING UNIT FOR A RING SPINNING DEVICE WITH TWO DELIVERY ROLLERS DEFINING A DELIVERY NIP THEREBETWEEN FOR A ROVING

[76] Inventor: Ernst Fehrer, Auf der Gugl 28, A-4020 Linz, Austria

[21] Appl. No.: 588,709

[22] Filed: Jan. 19, 1996

[30] Foreign Application Priority Data

Jan. 25, 1995 [AT] Austria ..... 125/95

[51] Int. Cl.[6] ..... D01H 5/28; D01H 13/04

[52] U.S. Cl. ..... 57/315; 57/75; 57/333; 57/350

[58] Field of Search ..... 57/315, 350, 328, 57/75, 351, 330, 333

[56] References Cited

U.S. PATENT DOCUMENTS

| | | | |
|---|---|---|---|
| 4,953,349 | 9/1990 | Fehrer | 57/315 |
| 5,085,046 | 2/1992 | Fehrer | 57/75 |
| 5,090,192 | 2/1992 | Stahlecker | 57/328 |
| 5,228,281 | 7/1993 | Stahlecker | 57/315 |
| 5,243,813 | 9/1993 | Stahlecker | 57/333 |
| 5,285,624 | 2/1994 | Stahlecker | 57/328 |
| 5,431,005 | 7/1995 | Fehrer | 57/315 |

FOREIGN PATENT DOCUMENTS

| | | | |
|---|---|---|---|
| 391328 | 3/1990 | Austria . | |
| 397823 | 11/1993 | Austria . | |
| 4032939 | 4/1992 | Germany | 57/328 |
| 4032940 | 4/1992 | Germany | 57/328 |
| 2215743 | 9/1989 | United Kingdom | 57/90 |

*Primary Examiner*—William Stryjewski
*Attorney, Agent, or Firm*—Collard & Roe, P.C.

[57] ABSTRACT

A drafting unit for a ring spinning device is described for use on a ring spinning device, comprising two delivery rollers (1, 2) defining between them a delivery nip (3) for at least one drawframe-treated roving (4), one of them forming a deflection length (5) with a slot-shaped suction zone (6) for the roving (4) exiting the exit nip (3), which extends between the delivery nip (3) and a pressure roller (7) arranged downstream in the sense of deflection, and having an air nozzle (8) offset sidewards with respect to the suction zone (6) for a blast of air directed towards the delivery roller (1) with a flow component transverse to the suction zone (6) which extends in an arc-shaped path between its feed end and its discharge end with the air nozzle (9) on the inside of the arc. To smoothly process long-staple fibres it is suggested that an additional air nozzle (9) associated with the pressure roller (7), which has a flow component transverse to the suction zone (6), be provided on the inside of the arc of the suction zone (6).

1 Claim, 1 Drawing Sheet

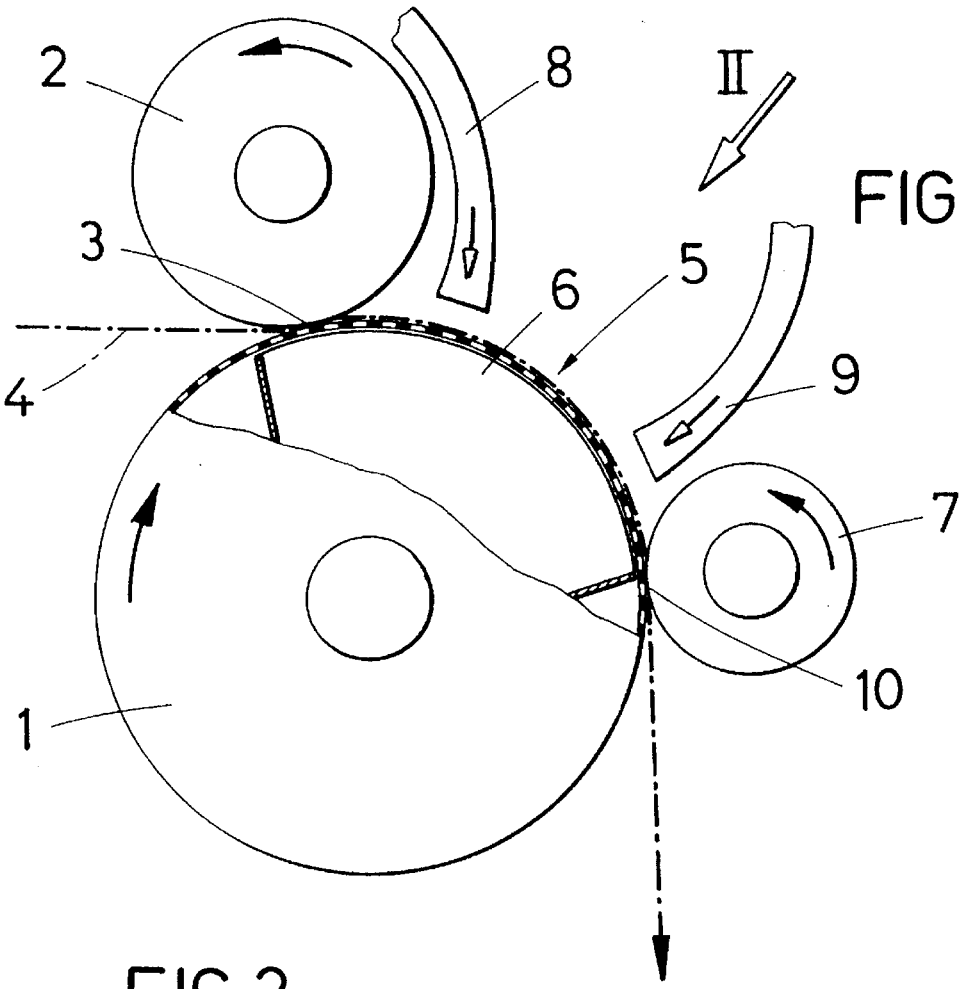
FIG.1
FIG.2
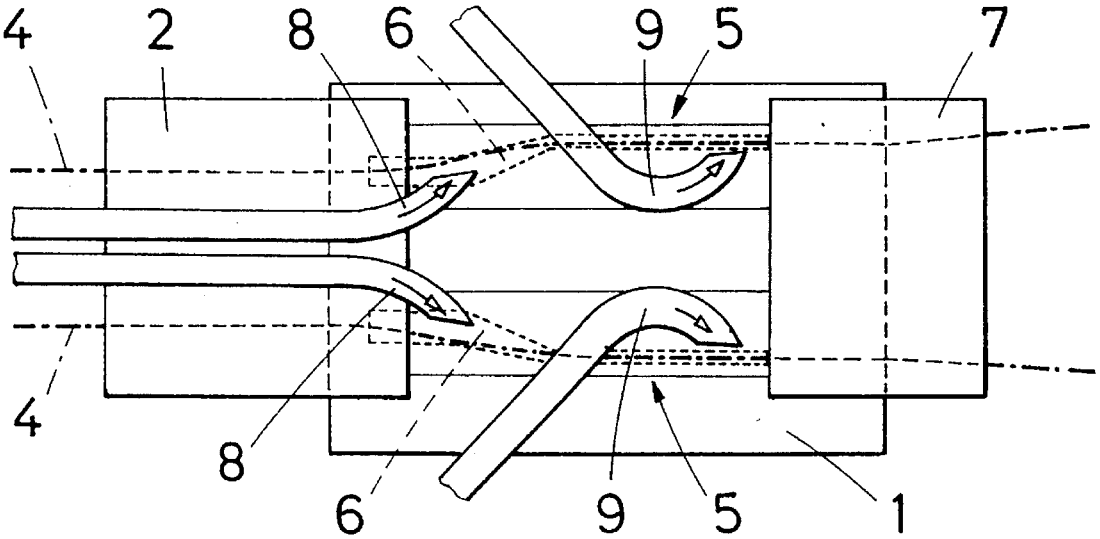

DRAFTING UNIT FOR A RING SPINNING DEVICE WITH TWO DELIVERY ROLLERS DEFINING A DELIVERY NIP THEREBETWEEN FOR A ROVING

BACKGROUND OF THE INVENTION

1. Filed of the Invention

This invention relates to a drafting unit for a ring spinning device comprising two delivery rollers defining between them an exit nip for at least one drawframe-treated roving, one of said rollers forming a deflection line with a slot-shaped suction zone for the roving exiting the exit nip, which extends between the exit nip and a downstream pressure roller arranged in the sense of deflection, and comprising an air nozzle offset laterally with respect to the suction zone for a blast of air directed towards the delivery roller with a flow component transverse to the suction zone, which extends in an arc-shaped path with the air nozzle on the inside of the arc between its feed and its discharge end.

2. Description of the Prior Art

To feed a ring spinning device with a drawframe-treated, narrow roving, which has already been adapted to a large extent to the future cross-section of the yarn, it is known (AT-PS 391 328) to provide one of the two delivery rollers of the drafting unit with a slot-shaped suction length downstream of the exit nip and to arrange, at least on one side of this suction length, an air nozzle whose blast of air is directed crosswise to the suction length in a way that the drawframe-treated roving, which is retained from being displaced sidewards in the exit nip of the drafting rollers and in a guide nip of a downstream pressure, will be bunched up to form a comparatively narrow roving by the cooperation of the suction air and air blow streams. The narrow roving exiting the guide nip defined by the pressure roller facilitates the twisting of the fibres by means of the revolving urchin of the ring spinning device, because the fibres, which otherwise would be arranged laterally in a wider roving, need not be collected in a well-defined triangular area to form a circular-section roving. The smaller this spinning triangle can be kept the more favourable are the resultant conditions of twist, all the more so as the strength of the yarn adjacent to the spinning triangle is still very low because the yarn has not been twisted yet.

To improve these spinning conditions it has in addition been suggested (U.S. Pat. No. 4,953,349) to bulge the slot-shaped suction zone sidewards away from the air nozzle between its feed end and its discharge end. The protuberance of the slot-shaped suction area away from the air nozzle enables a larger tensile stress to be applied to the fibres of the roving adjacent to the outside arc than is applied adjacent to the inside arc of the suction zone which, in an interaction with the air nozzle blast of air directed against the inside of the arc, involves a marked improvement in the bunch-up of roving fibres such that the bunched roving will already be transformed, to a large extent, into a cross-sectional shape that only requires a small spinning triangle for conversion to the cross-sectional shape of the resultant yarn. Although such steps have proved to be excellent for short-staple fibres malfunctions might arise when long-staple fibres are used if, despite an increase in the diameter of the delivery roller defining the deflection length for the roving, the spacing between the exit nip of the delivery rollers and the guide slot between the pressure roller and the associated delivery roller along the suction zone is smaller than the length of single staple fibres, which then cannot join closely to the path of the roving in the suction zone area. The bunching effect will be impaired by the path of the fibres which comes about by the grip acting on either side of the fibres.

SUMMARY OF THE INVENTION

The object underlying the invention therefore is to ensure that the drawframe-treated roving for use on a drafting unit for a ring spinning device of the aforementioned type is bunched smoothly even when it is composed of long-staple fibres.

This object is solved by the invention in that on the inside of the arc of the suction zone an additional air nozzle is arranged, which is associated with the pressure roller and has a flow component transverse to the suction zone.

An additional air nozzle adjacent to the pressure roller causes the fibres of the roving to undergo bunching in the very front of the spinning triangle forming downstream of the guide slot between the pressure roller and the delivery roller, which bunching will smooth out any non-uniformities caused by staple fibres that happen to pass into the vicinity of the guide roller between the pressure roller and the delivery roller before their rear end has been released in the nip between the delivery rollers of the drafting unit. The front end of these large-length staple fibres is pressed against the other fibres of the roving by the transversely acting force of the additional air nozzle in a way that a well-bunched roving enters the guide slot between the pressue roller and the delivery roller and any fault that might occur in the fibre bunching process between the two air nozzles cannot have any adverse effect on the formation of the spinning triangle.

BRIEF DESCRIPTION OF THE DRAWING

The subject matter of the invention is represented in the drawing by way of example; wherein:

FIG. 1 is a side view of some components of a drafting unit according to the invention for use on a ring spinning frame in a partial elevation, and FIG. 2 is a top view of the drafting unit adjacent to the delivery roller defining the suction zone in the direction of the arrow II.

DETAILED DESCRIPTION OF PREFERRED EMBODIMENT

The delivery rollers 1 and 2 of a drafting unit for a common ring spinning device (not shown) having two spinning units form a delivery nip 3 between them for two rovings 4 that were drawn in a parallel side-by-side relationship. The lower one of these delivery rollers 1, 2 provides a deflection length 5 where a suction zone 6, which extends between the delivery nip 3 and a pressure roller 7 arranged downstream in the sense of rotation, is associated with each roving 4. Air nozzles 8%and 9 are associated with the suction zones 6 both adjacent to the upper delivery roller 2 and adjacent to the pressure roller 7 between the two suction zones 6, which air nozzles are directed towards the delivery roller 1 so as to form a flow component transverse to the roving. Since the guides of the roving 4 adjacent to the exit nip 3 and adjacent to the guide slot 10 between the pressure roller 7 and the delivery roller 1 are offset axially to each other an arc-shaped path will result for the rovings 4 and the suction zones 6 will follow this path as can be seen from FIG. 2. The effect of this arc-shaped path of the suction zones 6 is that a tensile stress imparted to the fibres of the roving adjacent to the outside arc is larger than the one imparted adjacent to the inside arc of the protuberance, which wiill yield a particularly beneficial bunch-up of fibres in conjunction with the crosswise extending flow component of the blast of air that exits the air nozzles 8 and 9, even when single fibers are longer than is the spacing between the nip 3 and the guide slot 10 along the path of the roving and, therefore, are not free to adapt to the path of the roving. That is, the additional air nozzles 9 adjacent to the pressure roller 7 cause fibres to bunch up just in front of the guide slot 10 so that any non-uniformities that might be encountered subsequent to the bunch-up by the air nozzles 8 will be evened out. The good bunch-up of fibres leads to a cross section of the roving which is largely adapted to the cross-section of the yarn in a way that the spinning triangle, which forms a transition zone between the cross-section of the roving and the cross-section of the yarn, may be kept small downstream of the guide slot 10 between the pressure roller 7 and the delivery roller 1. This provides invariably good spinning conditions even when using long-staple fibers such as those of wool.

What is claimed is:

1. A drafting unit for a ring spinning device comprising (a) two delivery rollers defining therebetween a delivery nip for at least one drawframe-treated roving, (1) one of the rollers forming a deflection length with a slot-shaped suction zone for the roving exiting the delivery nip in an arc-shaped path in a direction of delivery from a feed end of the deflection length to a discharge end thereof, the arc-shaped path having a convex outside and a concave inside, (b) a pressure roller arranged downstream in the direction of delivery, (1) the deflection length extending between the delivery nip and the pressure roller, (c) a first air nozzle offset sidewards with respect to the suction zone and arranged to direct a blast of air towards the one delivery roller with a flow component transverse to the suction zone at the inside of the arc-shaped path, and (d) a second air nozzle associated with the pressure roller and arranged to direct a blast of air towards the one delivery roller with a flow component transverse to the suction zone at the inside of the arc-shaped path.

* * * * *